US007210909B2

(12) United States Patent
Escure et al.

(10) Patent No.: US 7,210,909 B2
(45) Date of Patent: May 1, 2007

(54) CONNECTION BETWEEN BLADED DISCS ON THE ROTOR LINE OF A COMPRESSOR

(75) Inventors: Didier Escure, Nandy (FR); Gérard Miraucourt, Brie Comte Robert (FR); Francis Soniak, Bures sur Yvette (FR); Erick Boston, Cesson (FR); Jacques Audet, Corbeil Essonnes (FR); Marie-France Bourgeois, Rognes (FR); Daniel Dao, Savigny le Temple (FR)

(73) Assignee: Snecma Moteurs, Paris (FR)

( * ) Notice: Subject to any disclaimer, the term of this patent is extended or adjusted under 35 U.S.C. 154(b) by 78 days.

(21) Appl. No.: 10/885,110

(22) Filed: Jul. 7, 2004

(65) Prior Publication Data

US 2005/0025625 A1 Feb. 3, 2005

(30) Foreign Application Priority Data

Jul. 11, 2003 (FR) ..... 03 08556

(51) Int. Cl.
*F01D 5/06* (2006.01)

(52) U.S. Cl. ..... 416/198 A; 416/201 R; 416/244 A; 29/402.03; 29/464; 29/525.02; 29/889.1; 29/889.21

(58) Field of Classification Search ..... 415/199.4, 415/199.5, 216.1; 416/198 A, 200 A, 201 R, 416/244 A; 29/402.03, 464, 525.02, 889.1, 29/889.21; 403/355–338, 408.1
See application file for complete search history.

(56) References Cited

U.S. PATENT DOCUMENTS

| | | | | |
|---|---|---|---|---|
| 5,052,891 | A * | 10/1991 | Burkholder | 416/198 A |
| 5,211,541 | A * | 5/1993 | Fledderjohn et al. | 416/198 A |
| 5,350,278 | A * | 9/1994 | Burge | 416/198 A |
| 5,388,963 | A * | 2/1995 | Dimmick et al. | 416/198 A |
| 6,499,957 | B1 | 12/2002 | Klingels et al. | |

FOREIGN PATENT DOCUMENTS

| | | |
|---|---|---|
| EP | 1 087 100 A2 | 3/2001 |
| EP | 1 122 443 A2 | 8/2001 |

* cited by examiner

*Primary Examiner*—Christopher Verdier
(74) *Attorney, Agent, or Firm*—Oblon, Spivak, McClelland, Maier & Neustadt, P.C.

(57) ABSTRACT

A first rotor piece includes a first ring provided with a succession of holes and notches. An assembly is formed by a second rotor piece fixed to a third rotor piece. The second piece ends downstream in a second ring including holes. The third piece ends upstream in a third ring including holes. The second and third rings are arranged against each other with their holes in alignment, and are fixed together by first fasteners. The first ring is arranged upstream of and against the assembly so that the notches fit around the first fasteners so that some of the holes of the first ring are aligned with holes of the assembly, with second fasteners fixing the first ring to the assembly.

17 Claims, 3 Drawing Sheets

CONNECTION BETWEEN BLADED DISCS ON THE ROTOR LINE OF A COMPRESSOR

Figure 1:
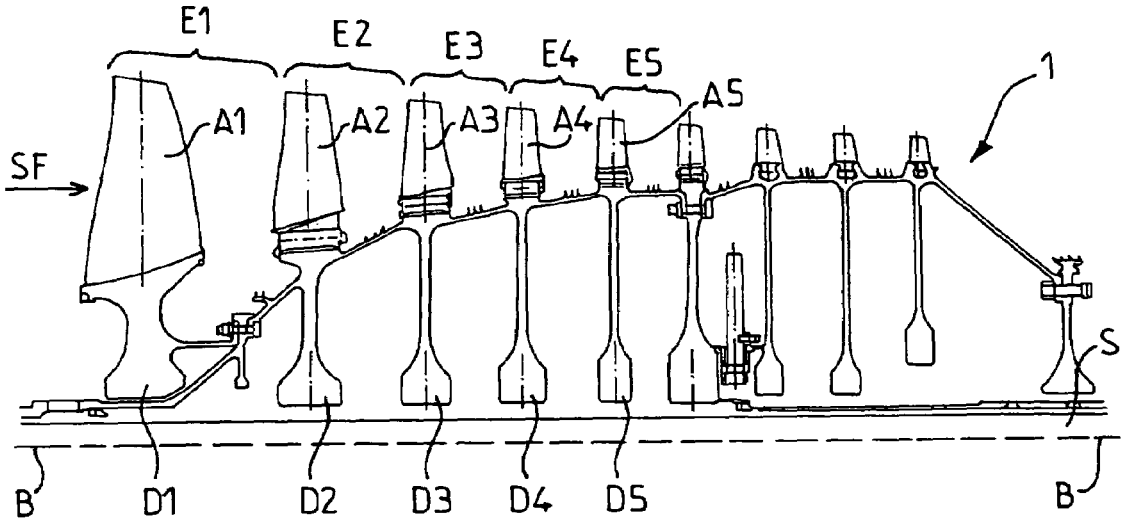

The invention relates to the field of high-pressure turbojet compressors, and more particularly to that of the connection between the bladed disc of the first stage of the compressor rotor and the bladed disc of the second stage of the compressor rotor.

In the case of aircraft turbojet engines, the compressor receives the intake air flow. The bladed disc at the intake of the compressor is liable to take in foreign bodies such as ice, birds or the like. Among the various bladed discs of the compressor, the first one is thus most exposed to damage by foreign bodies. For this reason, it is also the one that requires maintenance operations which may require removal of the bladed disc. Any dismantling of the rotor line of the compressor, which comprises various pieces, necessitates balancing and alignment operations that requires work in a properly qualified and well-equipped maintenance shop. During these dismantling operations, it is important for the rotor line not to be broken.

A solution has been proposed in EP 1 122 443, where a monobloc bladed disc (MBD) is used as a first bladed disc of the compressor. This bladed disc is fixed upstream by a flange to the intake of the compressor. This solution is not entirely satisfactory, however, since it does not make it possible to comply with certain criteria relating to the bladed disc, for example a vibration stability criterion, a service life criterion or a blade loss stability criterion.

It is an object of the present invention to improve the situation.

The invention relates to a part for attachment to the intake of a compressor rotor, this piece being suitable for forming a first piece of a compressor rotor.

According to an essential characteristic of the invention, the piece ends in a first ring provided with a succession of holes and notches.

According to another characteristic of the invention, the axis of the first ring is suitable for being centred on the axis of rotation of the compressor rotor in order to be attached to the intake of the compressor rotor, the first ring is suitable for being placed against an axisymmetric second piece of the rotor, which is fixed to an axisymmetric third piece of the rotor by fastening means and forms a second-piece/third-piece assembly of the rotor, the notches being suitable for fitting around the means of fastening the second-piece/third-piece assembly of the rotor, the holes of the first ring being suitable for being placed in alignment with the holes of the second-piece/third-piece assembly in order to fasten the first ring to the second-piece/third-piece assembly.

The first ring is preferably in a plane perpendicular to the axis of rotation of the rotor.

The piece advantageously comprises a disc and blades attached to its periphery.

The piece furthermore comprises a disc provided with a flange connected to the first ring, the flange and the ring being placed downstream of the disc so that the fastening of the disc to the second-piece/third-piece assembly can be carried out downstream of the disc with respect to the direction in which the flow travels through the compressor.

The invention likewise relates to a connection between a first piece as defined above, ending in a first ring provided with a succession of holes and notches, the axis of the first ring being centred on the axis of rotation of the compressor rotor in order to be attached to the intake of the compressor rotor, and an assembly formed by a second rotor piece fixed to a third rotor piece, the second piece forming the intake of the compressor rotor and ending downstream in a second ring comprising holes, the third piece ending upstream in a third ring comprising holes, the second and third rings being arranged against each other, so as to place their holes in alignment, and being fixed together by first fastening means, the first circular ring being arranged upstream of and against the second-piece/third-piece assembly so that the notches fit around the first means of fastening the second-piece/third-piece assembly of the rotor and so that at least some of the holes of the first ring are aligned with holes of the second-piece/third-piece assembly, with second fastening means fixing the first circular ring to the second-piece/third-piece assembly.

The second ring and the third ring are preferably in a plane perpendicular to the axis of rotation of the rotor.

The means of fastening the second-piece/third-pieceassembly of the rotor are advantageously shorter than the fastening means for fixing the first ring to the second-piece/third-piece assembly.

The fastening means furthermore comprise screw-nut systems.

The screw of the screw-nut system is preferably retained by a washer allowing the screw to hold when the nut is not there.

The invention relates in particular to a turbine engine comprising a high-pressure compressor provided with a connection as defined above.

The invention also relates to a method of fitting a connection as defined above, consisting in placing the second and third circular rings against each other, so as to place the holes in alignment, in fixing these second and third rings together with the first fastening means passing through some of the holes, in placing second fastening means, suitable for fixing the second-piece/third-piece assembly to the first piece, in the remaining holes, in placing the first circular ring upstream of and against the second-piece/third-piece assembly so that the notches fit around the means of fastening the second-piece/third-piece assembly of the rotor and so that the second fastening means pass through some of the holes of the first ring in order to fix the first circular ring to the second-piece/third-piece assembly.

The invention furthermore relates to a method of dismantling a connection as defined above, consisting in undoing the second fastening means in order to remove the first piece of the compressor rotor and retain the second-piece/third-piece assembly of the rotor.

Figure 2:
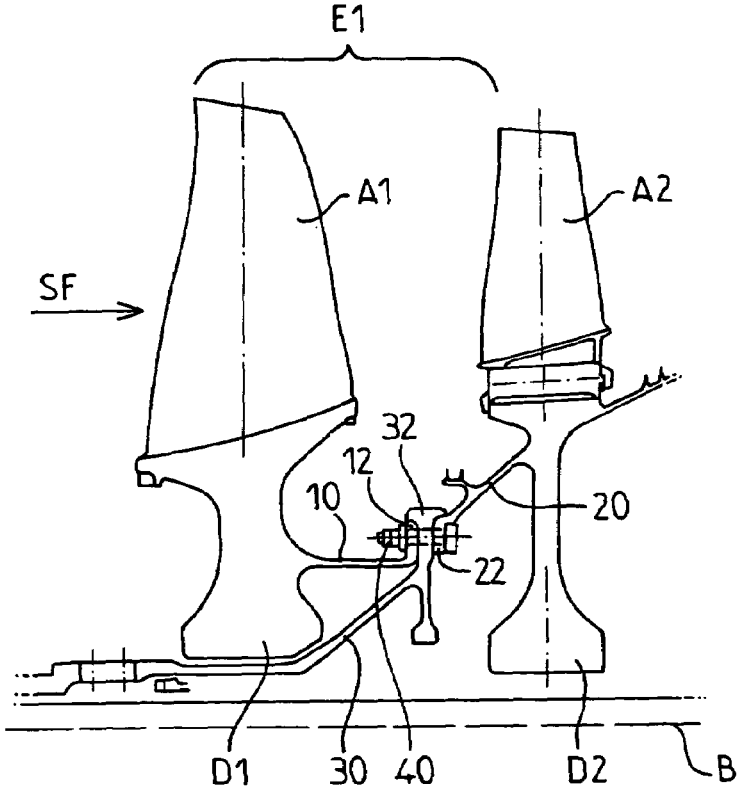
Figure 3:
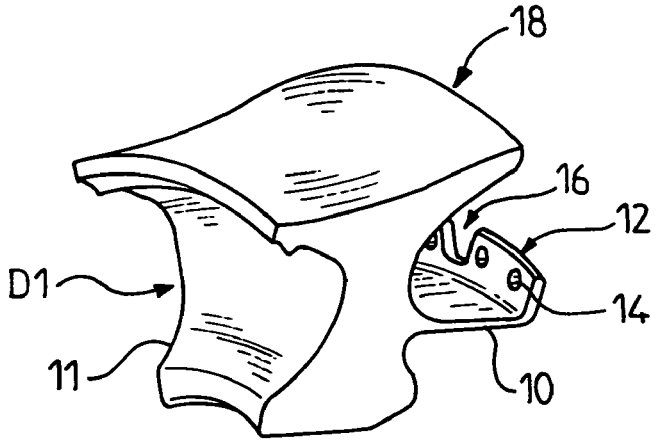
Figure 4:
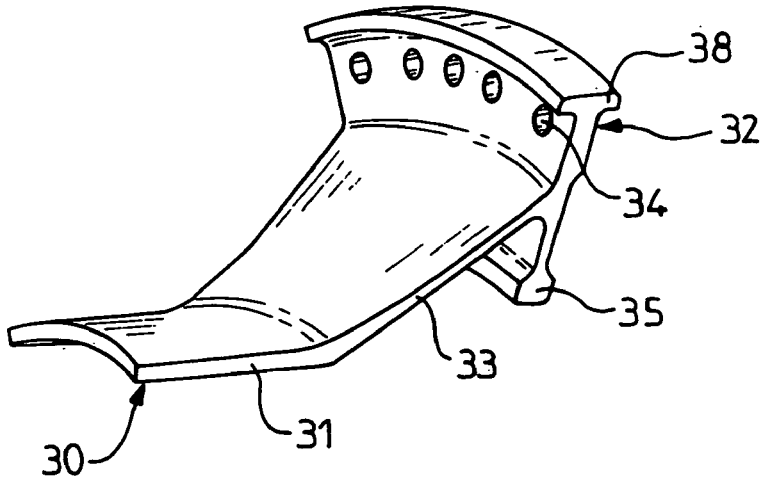
Figure 5:
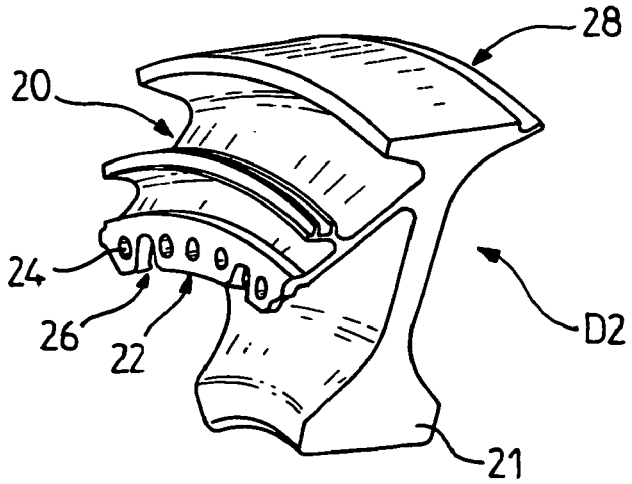
Figure 6:
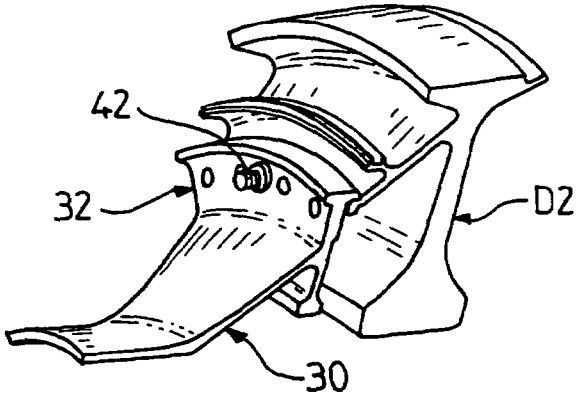
Figure 7:
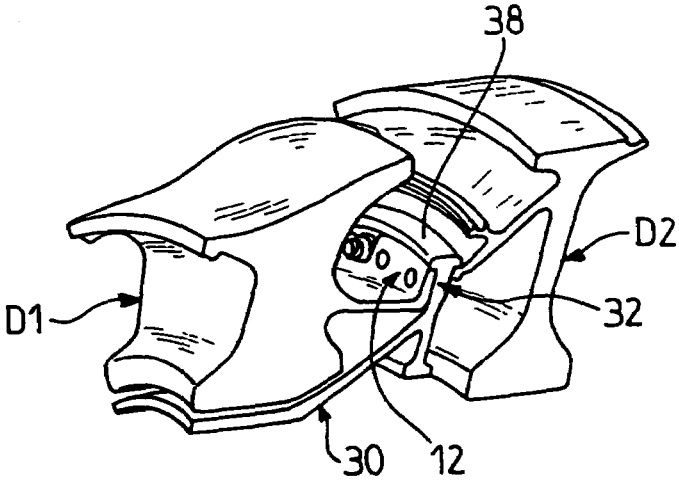
Figure 8:
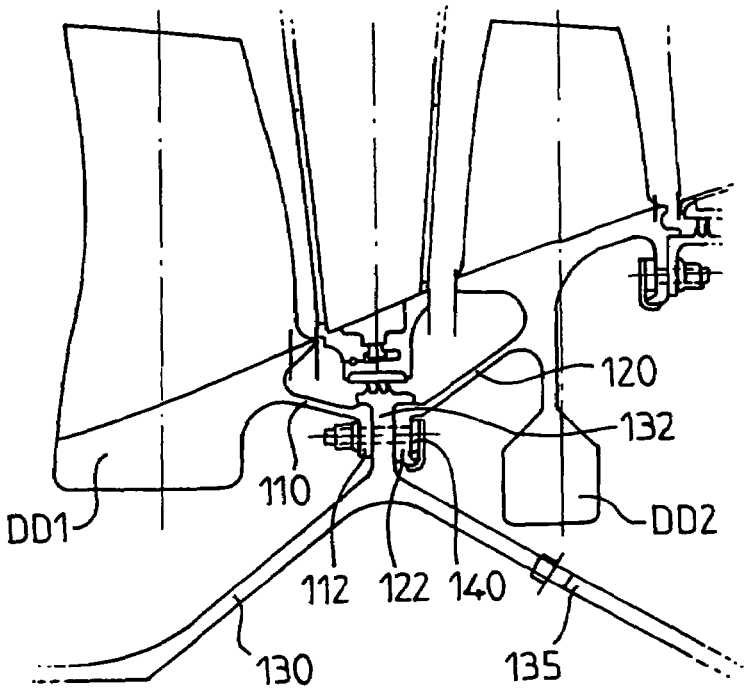

The following figures illustrate embodiments of the invention without implying any limitation:

FIG. 1 represents in section a half-view along the axis of rotation of a turbojet compressor composed of various bladed discs, FIG. 2 represents in detail the first and second bladed compressor discs of FIG. 1, which are joined together by a connection according to the invention, FIG. 3 represents in relief a sector of the first disc according to the invention without blades, FIG. 4 represents a sector of the journal according to the invention in relief, FIG. 5 represents in relief a sector of the second disc according to the invention without blades, FIG. 6 represents the first phase of fitting the connection according to the invention, which consists in assembling the journal and the second disc, FIG. 7 represents the second phase of fitting the connection according to the invention, which consists in assembling the first disc with the assembly formed by the journal and the second disc, FIG. 8 represents an alternative embodiment of the connection according to the invention.

The drawings essentially contain elements of a specific type. They can therefore serve not only to explain the description more clearly, but also contribute to defining the invention, as appropriate.

FIG. 1 represents a partial section of the rotor part of a high-pressure turbojet compressor composed of various compression stages E1 to E5, each comprising a disc D1 to D5 provided with a ring of blades A1 to A5. Downstream of each bladed disc, each compression stage is also composed of a flow rectifier (not shown) forming part of the stator part of the compressor. Each rectifier makes it possible to rectify the airflow before it enters the next compression stage. The rotor part and the stator part of the compression define a "stream" for the flow of air to be compressed. The term rotor line is used to describe the continuous outer surface of the rotor forming the lower boundary of this stream. The bladed discs D2 to D5 of the compressor are formed in a single piece, which is referred to as a disc assembly. The bladed disc D1 is advantageously a monobloc bladed disc which is attached to the rotor upstream of the disc assembly, so that it can be removed easily for maintenance and servicing work. This monobloc first bladed disc, which forms the first stage of the high-pressure compressor, is liable to take in foreign bodies such as ice, birds and the like. The rotor part of the compressor is driven in rotation by a shaft S, which is itself driven in rotation by a turbine located downstream of the compressor. The axis of rotation is denoted as B.

The nomenclature "upstream" or "downstream" of the elements of the rotor is to be understood with reference to the direction SF of the airflow in the compressor. The nomenclature "internal" referring to the rings (or a ring part) ending a piece is to be understood as meaning rings which extend towards the inside the piece, namely rings which start from the piece and whose radius decreases, and "external" is to be understood as meaning rings which extend towards the outside of the piece, namely rings which start from the piece and whose radius increases.

FIG. 2 represents the connection between the bladed discs D1 and D2 according to the invention. The rotor line is advantageously continuous at the intake of the high-pressure compressor. At the intake of the compressor, the rotor comprises a journal 30 of flared shaped ending in a radial ring 32. The disc D2 comprises an upstream flange 20 which extends in the direction of the journal and ends in a radial ring 22, the upstream surface of which comes in contact with the downstream surface of the radial ring 32 of the journal. The monobloc bladed disc D1 comprises a downstream flange 10 which extends in the direction of the radial ring 32 of the journal and ends in a radial ring 12, the downstream surface of which comes in contact with the upstream surface of the radial ring 32. The monobloc bladed disc D1, the journal 30 and the disc D2 are joined together by a fastening means, such as a screw-nut system 40 represented in FIG. 2, passing through mutually aligned holes of the rings 12, 32 and 22. The axisymmetric downstream flange 10 of the monobloc bladed disc D1 makes it possible to produce a downstream connection of this disc with the rotor in order to comply with the criteria of vibration endurance, service life and blade loss of this disc of the first compression stage.

The term radial ring is intended to mean a ring which lies in a radial plane, that is to say a plane perpendicular to the axis of rotation of the rotor. The rings could, however, be inclined with respect to the radial plane, so long as their inclination allows the relative placement of the surfaces of the rings against one another as described above.

Details of each element or piece of the connection will be described more particularly with reference to FIGS. 3, 4 and 5.

FIG. 3 represents the monobloc disc D1 without blades, this disc being suitable for accommodating blades. This first piece of the rotor comprises a circular base 11, on top of which there is a circular plate 18 suitable for accommodating blades. The circular base 11 comprises a downstream circular flange 10 which, by way of example, extends in the direction of the axis of rotation B and ends in the radial ring 12, which is provided with a succession of holes 14 and notches 16. In one exemplary embodiment, the radial ring 12 comprises thirty-two holes and eight notches, distributed symmetrically among the thirty-two holes. In the embodiment of the figure, the radial ring 12 is an external ring.

FIG. 4 represents a second piece of the rotor, namely the journal 30 comprising an upstream cylindrical first part 31 flaring into a frustoconical part 33, the latter ending downstream in a radial ring 32. This radial ring is composed of an internal radial part 35, referred to as a base, and an external radial part which ends in a rim 38 extending axially in an upstream direction and in a downstream direction. The external radial part comprises holes 34 intended to be placed in alignment with the holes and the notches of the external radial ring 12 of the upstream disc D1 on the upstream surface side of the radial ring 32, and with the holes of the radial ring 22 of the downstream disc D2 on the downstream surface side of the radial ring 32.

FIG. 5 represents the disc D2 without blades, this disc being suitable for accommodating blades. This second piece of the rotor comprises a circular base 21, on top of which there is a circular plate 28 suitable for accommodating blades. The circular base 21 comprises the upstream circular flange 20 which narrows in the upstream direction with a frustoconical shape and ends in the radial ring 22, which is provided with a succession of holes 24. In one exemplary embodiment, the radial ring 22 is internal and comprises forty holes. Notches 26 are distributed among the holes 24 so as to reduce the amount of material of the radial ring 22. These notches are also used as a means of indicating the position of the holes 24.

FIGS. 6 and 7 represent the steps involved in fitting a connection according to the invention.

According to FIG. 6, in a first step, the journal is connected to the disc D2 by positioning the downstream surface of the external radial ring 32 against the upstream surface of the internal radial ring 22 of the downstream disc D2, while aligning the holes of the external radial ring 32 and the holes of the internal radial ring 22. First fastening means 42 such as screw-nut systems, are placed in some of the aligned holes, these holes being identifiable on the basis of the notches 26 of the internal radial ring 22, for example. The identified holes should correspond to the distribution of the notches 16 of the disc D1, for reasons which will be explained below. Owing to the presence of the connection between the journal and the disc D2, the rotor line is continuous even when the upstream disc D1 is not there, in other words the stream of the airflow is sustained. The journal 30 and the disc D2 form an assembly which is fixed by the first fastening means, this assembly being referred to as the second-piece/third-piece assembly of the rotor. The remaining holes are provided with a part of second fastening means, for example screws without nuts, with the head of the screw being pressed against the downstream surface of the internal radial ring 22 of the disc D2 and the end of the stem of the screw protruding significantly on the upstream surface side of the external radial ring 32 of the journal 30, so that it can accommodate the thickness of the external radial ring 12 of the disc D1, followed by the fastening nut. The screws of the second fastening means are advantageously retained by a washer, thus preventing the screws from coming out of the holes when the nuts have not yet been engaged on the screw stems.

According to FIG. 7, in a second step, the axis of the disc D1 is centred on the axis of rotation of the compressor rotor in order to be attached to the intake of the compressor rotor. The external radial ring 12 is thus placed against the upstream surface of the external radial ring 32 of the journal. In order to do this:

the notches 16 are initially placed in alignment with the first fastening means, and are then fitted around the latter once the external radial ring 12 has been placed against the upstream surface of the external radial ring 32, the holes 14 of the first ring 12 are placed in alignment with the remaining holes of the second-piece/third-piece assembly of the rotor, or in other words the ends of the screw stems of the second fastening means, which protrude from the upstream surface of the external radial ring 12 of the disc D1, penetrate the holes 14.

Nuts are screwed onto the ends of the screws and are tightened against the upstream surface of the external radial ring 12 of the disc D1. The rim 38 of the external radial ring 32 of the journal advantageously covers the radial external edge of the external radial ring 12 of the disc D1 in the upstream direction, and the radial external edge of the internal radial ring 22 of the disc D2 in the downstream direction. The axial rim 38 thus makes it possible to exert a centripetal radial force on the external radial ring 12 of the disc D1 and on the internal radial ring 22 of the disc D2, in particular during operation.

The connection between the disc D1 and the journal/disc D2 assembly is dismantled in the following way. In the embodiment of FIG. 2, the stator is partly removed in order to gain access to the fastening means located behind the disc D1.

The nuts of the second fastening means are unscrewed and removed. The disc D1 can then be withdrawn by pulling axially in the upstream direction. The journal and the disc D2 remain, fixed together by the first fastening means, for example by eight screw-nut systems, and the ends of the screw stems of the second fastening means also remain, retained by the washers. The monobloc disc D1 can thus be removed from the rotor with great ease and without having to break the rotor line. The monobloc disc D1 can be repaired or replaced by another monobloc disc D1 in good condition. This disc D1 is fitted as explained above, by making the notches 16 coincide with the first fastening means and making the holes 14 coincide with part of the second fastening means, that is to say the screw stems.

The connection according to the embodiment of FIGS. 6 and 7 is fitted in the absence of the stator, which is installed after the connection has been set up. A variant of this embodiment could allow the connection to be fitted with the stator present: the screw-nut systems then need to be reversed (the nut being put in place of the head of the screw, and vice versa).

FIG. 8 represents an alternative embodiment of the connection according to the invention.

The disc DD1 accordingly consists of a flange 110 extending axially in a slightly inclined fashion and ending in an internal radial ring 112, which is suitable for being placed against the upstream surface of the external radial ring 132 of the journal 130. The ring 112 comprises a succession of holes and notches like the ring 12. The disc DD2 is the same as the disc D2, and its internal radial ring 122 is suitable for being placed against the downstream surface of the external radial ring 132 of the journal 130. The rings 132 and 122 are formed like the rings 32 and 22. The disc DD1 comprises a base which is shortened in comparison with the previous embodiment of the disc D1, so that it is possible to access the fastening means 140, which are similar to the fastening means 40 of the previous embodiment, via a passage between the base of the disc DD1 and the journal 130.

In particular, this embodiment makes it possible to avoid having to remove the stator when fitting or removing the disc DD1. In other regards, the fitting method and the dismantling method correspond to those described above.

In general, the first fastening means of the journal/disc D2 assembly are shorter than the second fastening means enabling the first circular ring to be fixed to the journal/disc D2 assembly.

The invention thus makes it possible to replace the monobloc bladed disc without special maintenance or time loss, this piece being the one most exposed to problems in service and having the greatest impact on the performance of the compressor.

The invention is not limited to a bolted connection between a disc, as a first rotor piece, and a fixed assembly of second and third rotor pieces, but extends to any piece requiring separate removal from connection with an assembly of pieces that are fixed together.

The invention is also not limited to the fastening device embodiments described above merely by way of example, but covers all variants which a person skilled in the art could envisage within the scope of the claims which follow.

The invention claimed is:

1. An assembly for attachment to the intake of a compressor rotor, said assembly comprising a first piece of the compressor rotor, wherein the first piece ends in a first ring provided with a succession of holes and notches and the axis of the first ring is suitable for being centered on the axis of rotation of the compressor rotor in order to be attached to the intake of the compressor rotor, the first ring is suitable for being placed against an axisymmetric second piece of the rotor, which is fixed to an axisymmetric third piece of the rotor by fastening means and forms a second-piece/third-piece assembly of the rotor, the notches of the first ring being suitable for fitting around the means of fastening the second-piece/third-piece assembly of the rotor, the holes of the first ring being suitable for being placed in alignment with holes of the second-piece/third-piece assembly in order to fasten the first ring to the second-piece/third-piece assembly, wherein the axisymmetric second piece of the rotor is a journal of the compressor rotor.

2. An assembly according to claim 1, wherein the first ring is in a plane perpendicular to the axis of rotation of the rotor.

3. An assembly according to claim 1, wherein the first piece comprises a disc and blades attached to its periphery.

4. An assembly according to claim 1, further comprising a disc provided with a flange connected to the first ring, the flange and the ring being placed downstream of the disc so that the fastening of the disc to the second-piece/third-piece assembly can be carried out downstream of the disc with respect to the direction in which the flow travels through the compressor.

5. An assembly for attachment to the intake of a compressor rotor, said assembly comprising a first rotor piece, wherein the first rotor piece ends in a first ring provided with a succession of holes and notches and the axis of the first ring suitable for being centered on the axis of rotation of the compressor rotor in order to be attached to the intake of the compressor rotor; an axisymmetric second rotor piece, the first ring being suitable for being placed against the axisymmetric second rotor piece; an axisymmetric third rotor piece, the axisymmetric second rotor piece is fixed to the axisymmetric third rotor piece by first fasteners to form a second-piece/third-piece assembly, the second rotor piece forming the intake of the compressor rotor and ending downstream in a second ring comprising holes, the third rotor piece ending upstream in a third ring comprising holes, the second and third rings being arranged against each other, so as to place their holes in alignment, and being fixed together by said first fasteners, the first ring being circular and being arranged upstream of and against the second-piece/third-piece assembly so that the notches fit around the first fasteners so that at least some of the holes of the first ring are aligned with holes of the second-piece/third-piece assembly, with second fasteners fastening-means fixing the first circular ring to the second-piece/third-piece assembly.

6. An assembly according to claim 5, wherein the second ring and the third ring are in a plane perpendicular to the axis of rotation of the rotor.

7. An assembly according to one of claims 5 or 6, wherein the first fasteners are shorter than the second fasteners.

8. An assembly according to claim 5, wherein the first and second fasteners comprise screw-nut systems.

9. A turbine engine comprising a high-pressure compressor provided with an assembly according to claim 5.

10. A method of fitting an assembly according to claim 5, comprising:

fixing said second and third rings together with said first fasteners passing through some of the holes;

placing said second fasteners, suitable for fixing the second-piece/third-piece assembly to the first piece, in the remaining holes of said second and third rings; and placing said first circular ring upstream of and against the second-piece/third-piece assembly so that the notches fit around the first fasteners so that the second fasteners pass through some of the holes of the first ring in order to fix the first circular ring to the second-piece/third-piece assembly.

11. A method of dismantling an assembly according to claim 5, comprising undoing the second fasteners in order to remove the first piece of the compressor rotor and retain the second-piece/third-piece assembly of the rotor.

12. A compressor rotor comprising:

a first rotor piece ending in a first ring provided with a succession of holes and notches;

an axisymmetric second rotor piece;

an axisymmetric third rotor piece which is fixed to said axisymmetric second rotor piece by first fasteners thereby forming a second-piece/third-piece assembly;

wherein the first ring is placed against said axisymmetric second rotor piece such that the notches fit around said first fasteners and the holes of the first ring are in alignment with holes of the second-piece/third-piece assembly.

13. A compressor rotor according to claim 12, wherein the first ring is in a plane perpendicular to the axis of rotation of the rotor.

14. A compressor rotor according to claim 12, wherein the first rotor piece comprises a disc and blades attached to its periphery.

15. A compressor rotor according to claim 12, wherein the first rotor piece comprises a disc provided with a flange connected to the first ring, the flange and the first ring being placed downstream of the disc.

16. A compressor rotor according to claim 12, further comprising second fasteners, and wherein the first ring is fixed to the second-piece/third-piece assembly by said second fasteners inserted in said holes in the first ring and in the holes of the second-piece/third-piece assembly.

17. An assembly for attachment to the intake of a compressor rotor, said assembly comprising a first piece suitable for forming a first part of the compressor rotor, wherein the first piece ends in a first ring provided with a succession of holes and notches and the axis of the first ring is suitable for being centered on the axis of rotation of the compressor rotor in order to be attached to the intake of the compressor rotor; an axisymmetric second piece suitable for forming a second part of the compressor rotor, the first ring is suitable for being placed against the axisymmetric second piece of the rotor; an axisymmetric third piece suitable for forming a third part of the compressor rotor, the axisymmetric second piece of the rotor is fixed to the axisymmetric third piece by first fasteners to form a second-piece/third-piece assembly, the notches of the first ring being suitable for fitting around the first fasteners, the holes of the first ring being suitable for being placed in alignment with holes of the second-piece/third-piece assembly in order to fasten the first ring to the second-piece/third-piece assembly, further comprising second fasteners, and wherein the holes of the first ring are placed in alignment with the holes of the second-piece/third-piece assembly and the first ring is fixed to the second-piece/third-piece assembly with the second fasteners inserted in said holes in the first ring and in the holes of the second-piece/third-piece assembly.

* * * * *

UNITED STATES PATENT AND TRADEMARK OFFICE

CERTIFICATE OF CORRECTION

PATENT NO. : 7,210,909 B2
APPLICATION NO. : 10/885110
DATED : May 1, 2007
INVENTOR(S) : Didier Escure et al.

It is certified that error appears in the above-identified patent and that said Letters Patent is hereby corrected as shown below:

Column 1, line 39, change “centred” to --centered--.
Column 1, line 64, change “centred” to --centered--.
Column 2, line 16, change “pieceas-” to --piece--.
Column 2, line 17, change “sembly” to --assembly--.
Column 3, line 35, after “inside” insert --of--.
Column 5, line 8, change “centred” to --centered--.

Signed and Sealed this

Twenty-eighth Day of August, 2007

JON W. DUDAS
*Director of the United States Patent and Trademark Office*